US005492197A

United States Patent [19]

Yonahara

[11] Patent Number: 5,492,197

[45] Date of Patent: Feb. 20, 1996

[54] FRAME PARTS FOR TEMPORARY LADDER

[76] Inventor: Yoshihiro Yonahara, 255-4, Oaza Iida, Omiya-shi, Saitama-ken, Japan

[21] Appl. No.: 196,423

[22] Filed: Feb. 14, 1994

[30] Foreign Application Priority Data

Feb. 18, 1993 [JP] Japan ..... 5-010925 U

[51] Int. Cl.[6] ..... E04G 3/10

[52] U.S. Cl. ..... 182/83; 182/150; 182/130

[58] Field of Search ..... 182/150, 83, 82, 182/115, 130, 151, 223, 222, 142, 63; 248/172

[56] References Cited

U.S. PATENT DOCUMENTS

| | | | |
|---|---|---|---|
| 2,536,268 | 1/1951 | Dillon | 248/172 X |
| 4,050,257 | 9/1977 | Parks et al. | 182/222 X |
| 4,060,150 | 11/1977 | Hughes | 182/151 |
| 4,388,982 | 6/1983 | Yonahara | 182/150 X |
| 4,766,975 | 8/1988 | Whitson | 182/150 |
| 4,944,366 | 7/1990 | Pryor | 182/63 |

FOREIGN PATENT DOCUMENTS

| | | | |
|---|---|---|---|
| 143060 | 8/1983 | Japan . | |
| 18022 | 5/1984 | Japan . | |
| 518416 | 10/1976 | U.S.S.R. | 182/151 |

*Primary Examiner*—Alvin C. Chin-Shue
*Attorney, Agent, or Firm*—Bauer & Schaffer

[57] ABSTRACT

A temporary scaffold comprising a platform section and an auxiliary section, each comprising a E-shaped frame formed of an arrangement of pipes. The pipes are telescopically connected in end-to-end relationship. As a result, the platform and auxiliary sections are interconnected so that their connected length is adjustable.

3 Claims, 4 Drawing Sheets

FRAME PARTS FOR TEMPORARY LADDER

FIELD OF THE INVENTION

The present invention relates to the construction of temporary scaffolding for use at building constructions sites, subway construction sites or at other civil engineering sites.

Heretofore, scaffolds were used at building constructions sites or in the vertical shaft at the sites of subway construction to provide a stairway for workers moving between the ground level and the working place, as well as to provide a platform on which the workers may easily stand and work.

The inventors of the present invention have already provided ladder devices which can be used at the building construction site by hanging on the wall surface of the building an another type of ladder which can be used by depending from the ground level into the underground working place (see Japanese Patent Application Laid Open No. 143060/1983 and Japanese Utility Model Publication No. 18022/1984).

The aforementioned ladder devices handle easily and are simply placed at the construction site of building by hanging it on the outer surface of the building and which can be stored and transported by piling one on top of the other after use.

However the prior ladder devices cannot be used under some occasions because they are constructed having frame parts with a fixed size.

That is, in some cases the ladder devices are too small to adapt to a hanging beam at one construction site or they are too large to place at another construction site.

Therefore, one is required to various frame parts with different sizes. This, however, is not economical because they take much trouble in manufacturing and need wider storage space and so on.

BRIEF SUMMARY OF THE INVENTION

The present invention was made in consideration of the aforementioned circumstances and has an object to provide interconnecting frame parts for erecting temporary scaffolds which are capable of being adapted to a hanging beam provided on the upper part of various construction sites so as to be freely placed without any restriction as to size and space and which are easy to handle during storing and transporting. This is obtained by reducing each of the interconnecting frame parts to a minimum size and capable of disassembly after use, even though one of the frame parts, constituting the temporary scaffold may have been deformed or damaged.

A further advantage lies in the ability of replacing a frame part without wasting the whole ladder so as to provide great economy.

The present invention comprises a scaffold having a plurality of stacked units, each unit comprising a platform and an interlocking auxiliary extension, both of which being formed of hollow pipe materials in the shape of an E-frame. The legs of the platform and the extension telescope one into the other to enable the unit to be expanded or contracted in situ. An L-shaped deck preferably of mesh mat or grating is applied on the upper surface of the platform to provide a walking surface fully over one section of the E-shape and partially over the corner edge of the other section. The part of the other section not covered by the deck forms an opening allowing communication between the adjacently stacked platforms. Pivotally mounted to the underside of the platform at the edge of the opening is one end of a ladder or staircase, the other end of which depends at an angle to the deck of the platform below. Removable fasteners are provided to fix the platform and the auxiliary frame at selected predetermined expanded position and each corner of the unit is provided with suitable hardware, whereby the adjacently stacked units are connected to each other and by which the unit may be hoisted from the ground.

The frame part of the present invention constructed as aforementioned is freely adjustable in width (or length, as viewed) according to the situation of the construction site because the platform part and the auxiliary frame part are adjustably combined and the distance between these parts can be freely expanded and contracted.

That is, when the temporary ladder is to be erected, the wall surface of an architectural member such as a building, or on the vertical shaft at the subway construction site or various civil engineering works and the like, is provided with a pair of spaced hanging beams, the platform and the auxiliary frame are expanded or contracted to adjust the width of the ladder to the distance between these hanging beams. To effect his adjustment, the frame members are provided with fixing hole provided on the longitudinal bridges of the platform and a through hole provided on the longitudinal bridges of the auxiliary frame section which meet each other, then fixed in one body by a bolt inserted into selected corresponding holes.

The frame parts according to the present invention can be used by combining and connecting the platform part and auxiliary frame part in one body with the predetermined width, piling up an appropriate number of frame parts thus combined, then connecting and hanging each other at each corner using an appropriate length of the flexible hoisting machine, preferably a chain hoist to construct a ladder. A crane and the like will be used to install the scaffold at the construction site.

That is, the ladder may be lifted up from the uppermost frame in the stored collapsed pile using a crane, then the flexible hoisting parts provided at each corner of the uppermost scaffold can be connected to the hanging beams provided on the building.

For convenience at storage, transportation or after use, the fastening means are removed from the platform and the auxiliary frame and the scaffold is contracted to the minimum size or disassembled. In case one of the platform or the auxiliary frame parts has been deformed or damaged, the deformed or damaged part can be replaced with a new part. Therefore, it is economical since it not needed to waste the whole ladder.

DETAILED DESCRIPTION OF THE INVENTION

Figure 1:
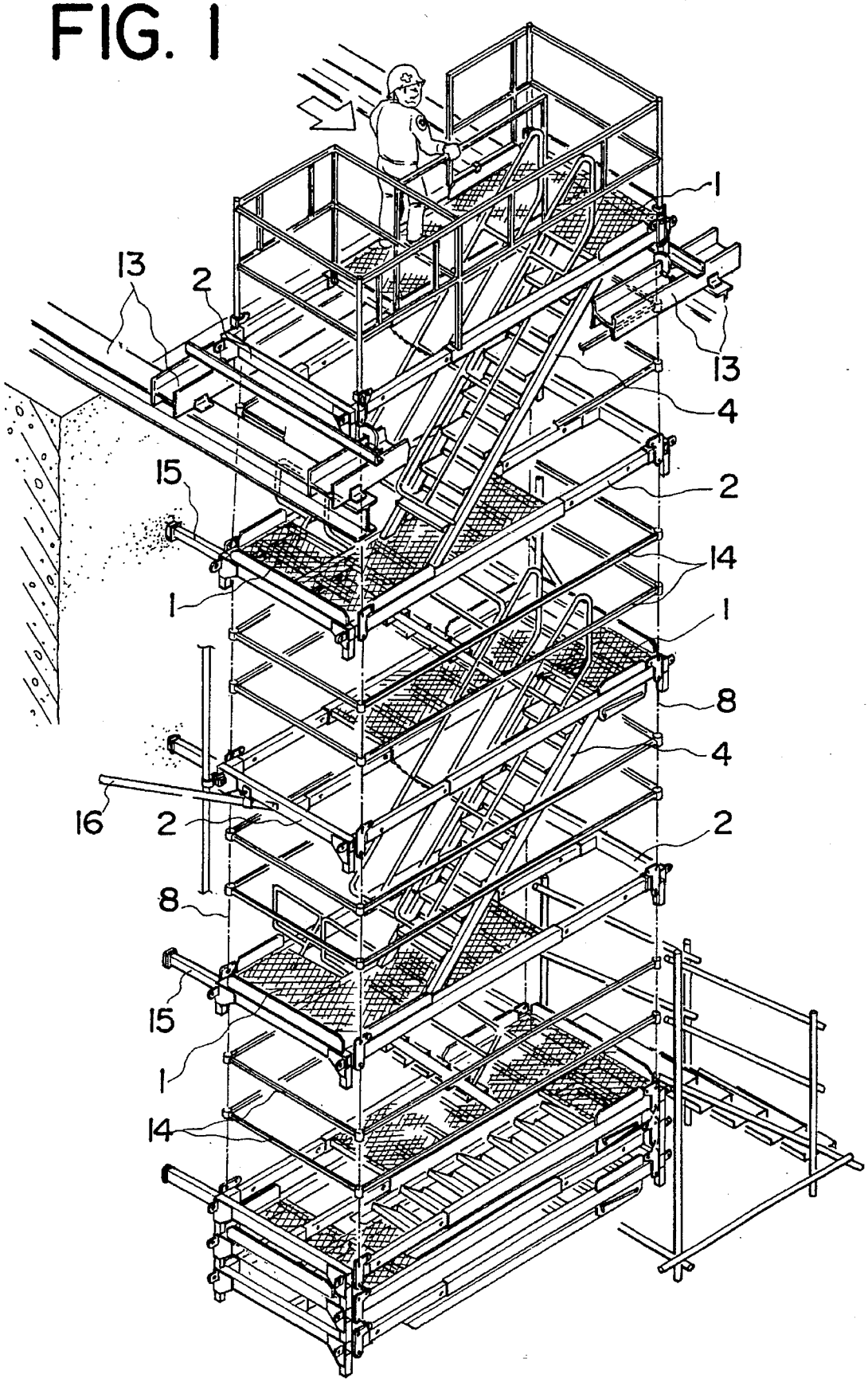
FIG. 1 is a perspective view showing a temporary ladder using frame parts according to the present invention.

One embodiment of the present invention will be explained referring to the drawings as follows. As shown in the drawings, the present invention is constructed as a scaffold from a plurality of substantially rectangular platform sections 1 and an auxiliary frame section 2 interconnected in one body.

Figure 2:
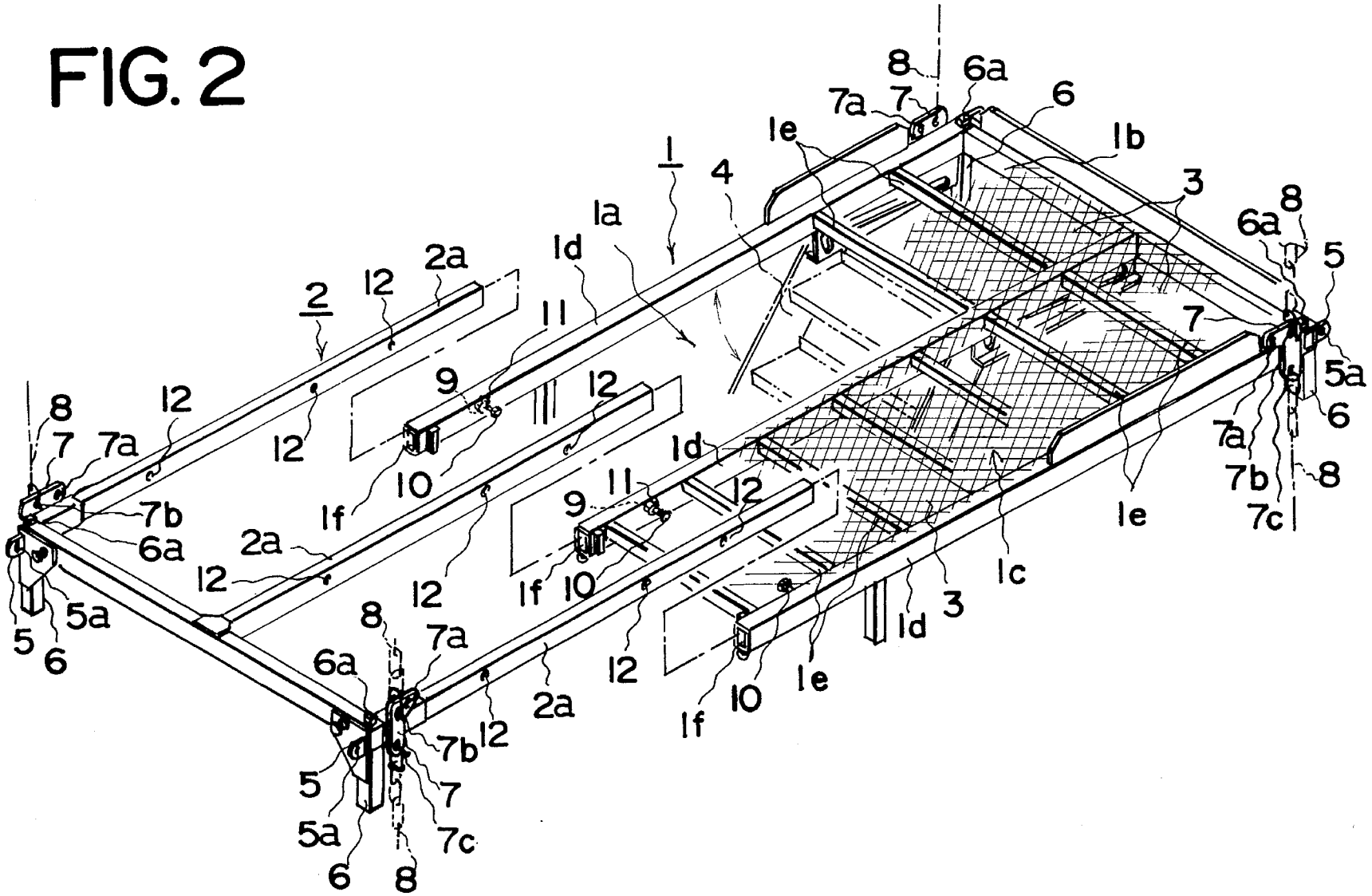
FIG. 2 is a disassembled perspective view of a frame part according to the present invention.

Firstly, the platform section 1 will be explained. The platform section 1 is formed of pipe members arranged in a substantially E shape. The pipe members are preferably square in cross section and made from metal such as steel. An L-shaped waling face 3 is provided on a part of the upper surface 1*a* to cover a transverse of connecting rail 1*b* and a longitudinal position of 1*c*, a shown in FIG. 2 in detail.

That is, the platform is constructed of an appropriate number of transverse bridges 1*e* are provided between two of three longitudinal bridges 1*d* at an appropriate interval and the walking face 3 is formed by stretching wire mesh, expanded metal or the like on the upper surface of these bridges.

In the portion of the platform where the walking face 3 is not formed, that is, the inner edge of the walking face 3, there is attached the upper edge of a ladder 4 so as to be freely pivotal. The ladder 4 is provided with an appropriate angle of inclination downward and so as to be able to pivot upward to the level of the lower surface of said platform 1, if necessary. The walking face 3 may be formed not only by wire mesh, expanded metal and the like also by skid-proof plated materials.

Figure 3:
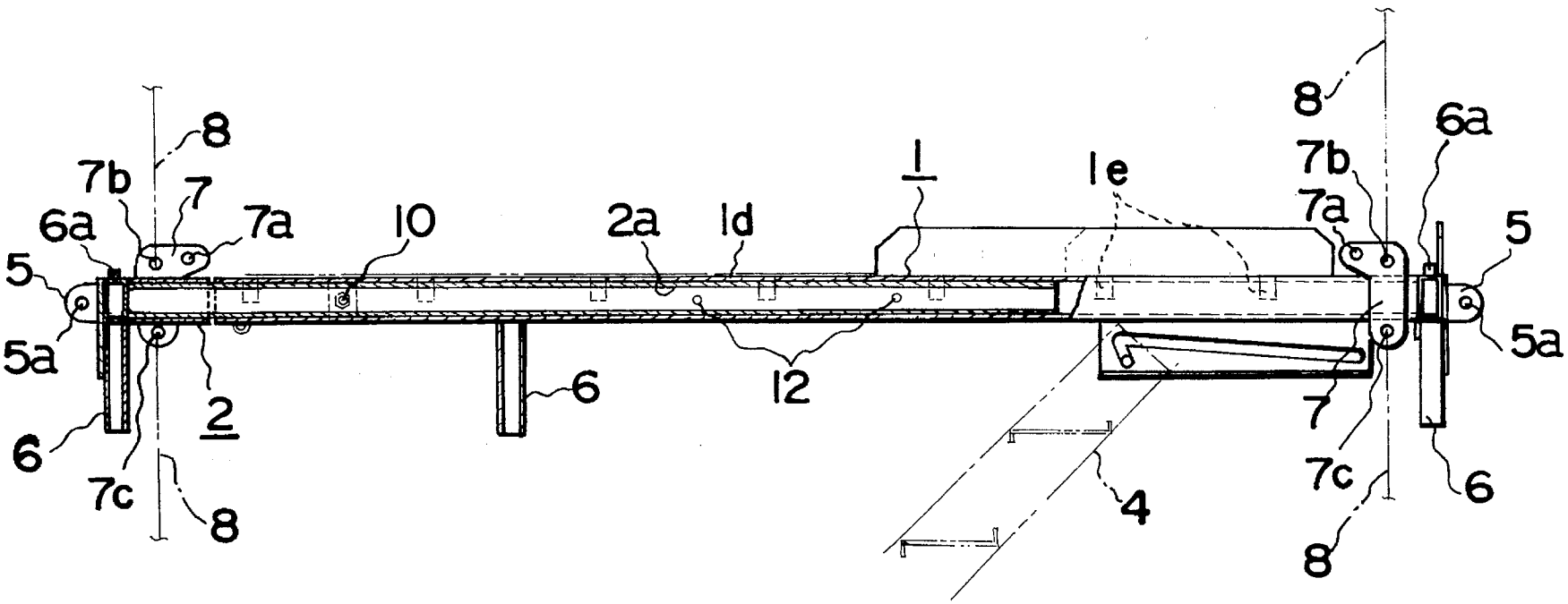
FIG. 3 is a vertical section view showing the front of a pat of a frame part according to the present invention.

As seen in FIG. 3, a bracket 5 is provided on both sides of said connecting rail 1*b* so as to protrude a little outwardly therefrom. It is also provided with a through hole 5*a* which is used to lift the platform up by a crane or the like during erection of the temporary ladder or loading and unloading of materials.

A pipe stand 6 is formed at the corners of the connecting rail 1*b* so as to provide a space for housing the ladder 4 when pivoted in between the upper and lower platform sections 1, and the auxiliary frame sections 2 when the scaffold units are piled upon each other. The pipe stand 6 provided with a convex part 6*a* on the upper surface thereof so as to fit with a hollow part of the lower end of the pipe stand 6 of the upper platform section 1, and the auxiliary frame section 2 to prevent slipping between each tier of the frames.

A holding bracket 7 is provided near each end, that is, at each outer corner part of said connecting rail 1*b*, and provided with through holes 7*a*, 7*b* and 7*c* on either upper or lower parts thereof.

The through holes 7*b* of said holding bracket are connected with the through hole 7*c* provided on the corner of the lower auxiliary frame 2 by a flexible hoisting accessory 8 with predetermined length. Said through hole 7*a* will be explained later, but this is used for piling up at the time of storage or during transportation.

A fixing hole 9 is provided nearby the inner end of the longitudinal bridge 1*d* and a nut 11 to receive a connecting bolt 10, which will be explained later, is welded on the opening thereof.

Now the auxiliary frame part 2 will be explained. The auxiliary frame section 2 is formed in the almost same E-shape as the platform section and placed end to end, the platform section 1. The inner end of each longitudinal bridge 2*a* of the auxiliary frame is formed in sufficient size to be able to be inserted into a corresponding pipe opening if at the inner free end of a longitudinal bridge 1*d* constructing the platform section 1.

Further, both end parts of the connecting rail 2*b* of this auxiliary frame 2, that is, the outer corners are provided with each of the bracket 5, the pipe stand 6, the convex part 6*a* and the holding hardware 7 similarly to the platform section 1 and further an appropriate number of through holes 12 with the same diameter as the fixing holes 9 provided on the longitudinal bridge 2*a*.

The frame sections according to the present invention are combined by inserted the inner end of the longitudinal bridges 2*a* of the auxiliary frame section 2 into a respective open end 1*f* of the inner end of each longitudinal bridge 1*d* of the platform section 1. These frame parts are then connected into one body using the fixing bolt 10 after adjusting the total width so as to meet the required size at the erection place. The bolts 10 pass through predrilled holes in the longitudinal bridges.

Consequently, the frame sections connected as aforementioned are piled onto the ground right and left alternatively (FIG. 1), the holding hardware 7 on each outer corner thereof are connected by flexible hoisting part 8 with the pre-determined length to construct the necessary tiers of ladder and thus constructed ladder will be used by hanging on a hanging beam 13 at the construction site.

In FIG. 1, numeral 14 are guard rails to secure worker's safety, 15 are distance pieces and 16 are anti-rolling bars.

FIG. 5 shows the piling condition during storage and transportation. That is, in this case the flexible hoisting device is a chain. The overlay condition is kept and deformation out of loaded shape is protected using the chain during storage and transportation.

Figure 4:
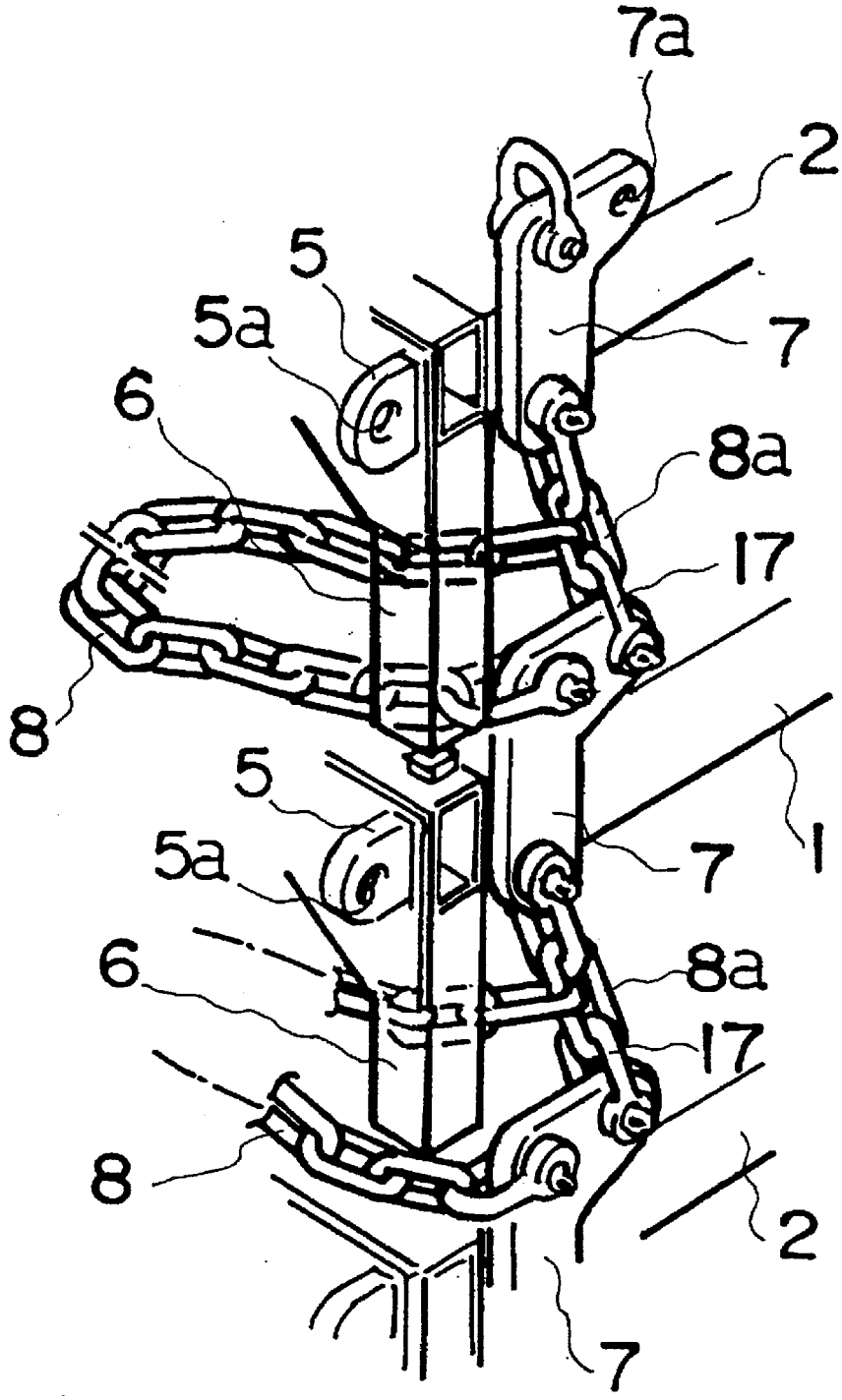
FIG. 4 is a perspective view showing the condition of holding hardware when frame parts are piled up each other for storage and transportation.

For this purpose the through hole 7*a* provided on said holding hardware 7 is used. That is, after piling up the frame parts according to the present invention, one of links 8*a* of the chain connected to the holding hardware 7 on the upper frame part, can be simply connected to the through hole 7*a* provided on the holding hardware 7 of the lower frame part through a shackle 17 as shown in FIG. 4.

When all four corner parts of the frame sections are connected in turn as aforementioned and the flexible hoisting part 8 is left as it is, the piled condition of appropriate tiers of the frame part can be kept and getting out of loaded shape can be prevented during storage and transportation so that safety can be secured. In addition, each frame part can be constructed to the minimum size in such occasion.

Further, the present invention allows the scaffold to be disassembled for storage and transportation. Furthermore, if any of the platform sections or the auxiliary frame sections become deformed or damaged during use, only that damaged part can be replaced. Therefore, it is economical since it is not needed to waste the whole ladder.

As aforementioned, the ladder constructed using the frame parts according to the present invention can be used at various construction sites, regardless of erection site, easy to handle during storage and transportation, and economical because it is not needed to waste the whole ladder even in case some parts are damaged.

What is claimed is:

1. A scaffold unit for a multi-tier scaffold comprising a platform section and an auxiliary section, each being formed by a corresponding E-shaped arrangement of pipes, the pipes of one section being telescopically insertable into the pipes of the other section to form a planar frame adjustable in length, the platform section including a deck mounted on the upper surface of said E-shaped pipes to provide a walking face, an opening, and a ladder pivotally mounted at one end to the pipes below said opening, the telescoping pipes being provided with means for securing said pipes in selected position along their connected length, whereby the length of the scaffold is adjustable while maintaining the frame planar and the opening and ladder in position.

2. The scaffold according to claim 1, wherein said deck is L-shaped and extends along a transverse edge and a longitudinal edge of said platform, the opening for the ladder extending along the opposite longitudinal edge.

3. The scaffold according to claim 1, including bracket means located at the exterior corners of said platform and auxiliary sections for hoisting and connecting said scaffold in use.

* * * * *